United States Patent [19]

Robison

[11] Patent Number: 4,791,921

[45] Date of Patent: Dec. 20, 1988

[54] KELP SHIELD FOR DIVER WORN EQUIPMENT

[75] Inventor: Charles R. Robison, Bakersfield, Calif.

[73] Assignee: Michael D. Shackelford, Bakersfield, Calif.

[21] Appl. No.: 58,779

[22] Filed: Jun. 5, 1987

[51] Int. Cl.[4] ..... A62B 7/04

[52] U.S. Cl. ..... 128/201.27; 2/2.1 R

[58] Field of Search ..... 128/201.22, 201.27, 128/201.29; 405/186; 2/2.1 R

[56] References Cited

U.S. PATENT DOCUMENTS 3,961,626 6/1978 Houlben et al. ..... 128/201.27 X
4,403,608 9/1983 Waruche ..... 128/201.29 X

FOREIGN PATENT DOCUMENTS 8602613 5/1986 European Pat. Off. ..... 405/186
795477 5/1958 United Kingdom ..... 2/2.1 R

*Primary Examiner*—A. Michael Chambers
*Assistant Examiner*—John C. Fox
*Attorney, Agent, or Firm*—Fleit, Jacobson, Cohn & Price

[57] ABSTRACT

A vertically elongated flexible panel is provided including a lower end to be downwardly overlap engaged with a diving equipment component supported and projecting outwardly from a lower body portion of a diver and an upper end for close registry with an upper body portion of the diver spaced above the aforementioned lower body portion. The upper end of the flexible panel includes structure for releasable anchoring to the diver upper body portion and the lower end of the flexible panel also may include structure for releasable engagement with at least the upper portion of the diving equipment component with which the lower end of the panel is overlappingly engaged.

4 Claims, 2 Drawing Sheets

KELP SHIELD FOR DIVER WORN EQUIPMENT

BACKGROUND OF THE INVENTION

1. Field of the Invention

This invention relates to a flexible, vertically elongated panel having upper and lower ends and adapted to be worn by a diver with the upper end of the panel anchored relative to an upper body encircling strap structure and the lower end of the panel at least lengthwise overlap engaged with the outer side of a portion of a diver's underwater equipment supported and projecting outward from a second lower body portion of the diver, the flexible panel being designed to deflect long lengths of kelp outward of the underwater equipment in order to prevent the kelp from becoming entangled with the equipment.

The instant invention is disclosed in two forms including a first form wherein the upper end of the panel is to be anchored relative to the rear portion of tee head encircling strap of a diver's underwater mask and the lower end of the flexible panel is to be overlap engaged with and releasably attached to the upperwardly projecting valve body of an air tank strapped to the back of the diver. The second disclosed form of the invention is specifically designed to have the upper end portion thereof anchored, by integral strap structure, about an upper calf portion of the leg of a diver beneath which a knife sheath and attendant knife or other underwater equipment is disposed and strapped to a lower calf leg portion. The lower end of the flexible panel of the second form of the invention ma be lengthwise overlap engaged with the upper portion of the associated knife sheath and knife supported therefrom.

2. Description of Related Art

Various different forms of protective garments including elongated flexible panels heretofore have been provided. Examples of these various previously known forms of protective garments are disclosed in U.S. Pat. Nos. 2,767,404, 3,668,707, 3,774,242, 3,879,763, 4,180,868, 4,460,089 and 4,593,417. However, these previously known forms of protective panels are not specifically designed to perform the intended functions of the two forms of shields specifically illustrated and described hereinafter.

SUMMARY OF THE INVENTION

The shield of the instant invention incorporates a flexible elongated panel with one end thereof to be anchored relative to a first upper body portion of a diver and the second end portion thereof adapted to be overlap engaged with at least the upper outer side portion of a piece of diver's underwater equipment supported from a second lower body portion of the diver.

A first large form of the invention includes structure at the upper end thereof for releasable securement to the head strap of a diver's underwater goggles or mask and incorporates integral strap structure at the lower end thereof for encircling and securement to the upper valve body of an air breathing tank strap supported from the back of a diver.

The second smaller form of the invention includes integral strap structure at its upper end for releasable securement about an upper calf leg portion of a diver and the lower end of the panel of the second form is contoured to overlap the outer sides of the upper portions of a knife sheath and accompanying knife strap supported from a lower calf leg portion of the diver.

The panels of the first and second forms of the invention are designed to laterally deflect kelp away from the diver and to prevent the kelp from becoming entangled with either the air tank of a diver or a knife supported from a leg worn knife sheath of the diver.

The main object of this invention is to provide an apparatus which will function to minimize the chances of kelp being entangled with underwater diving equipment worn by a diver.

Another object of this invention is to provide an apparatus designed in two forms with a first form specifically adapted to be used in conjunction with an air tank and the second form specifically adapted to be used in conjunction with a leg worn knife sheath and attendant knife.

Yet another important object of this invention is to provide an apparatus in accordance with the preceding object and constructed in a manner whereby very little weight will be added to a diver and underwater movements of the diver will not be incumbered by the invention.

A further object of this invention is to provide an apparatus which will be readily adjustable for use by divers of different sizes.

A final object of this invention is to provide an apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
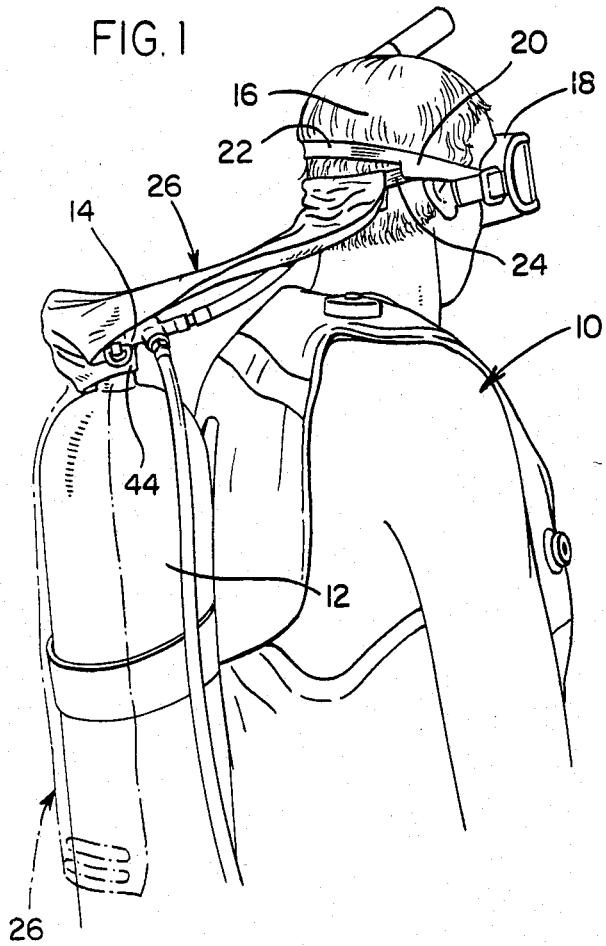
FIG. 1 is a perspective view illustrating a diver equipped with a diving mask and a back mounted breathing air tank, a first large form of the invention being operatively associated with a rear headband portion of the diving mask and the upper control valve of the breathing air tank.
Figure 3:
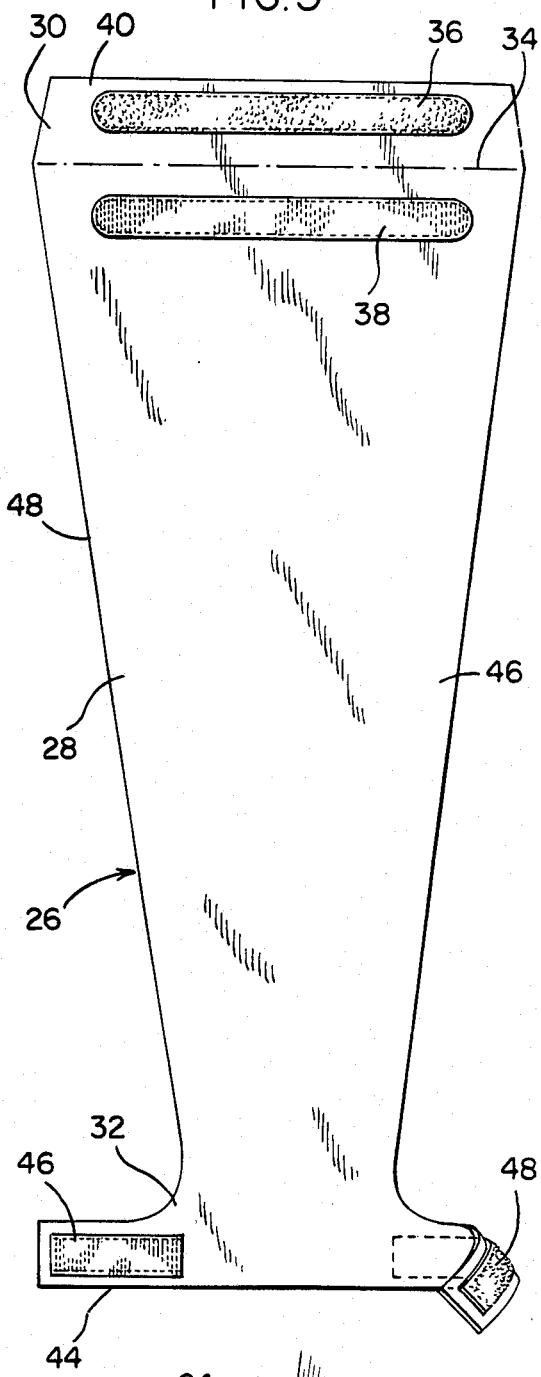
FIG. 3 is a plan view of the first form of the invention illustrated in FIGS. 1 and 2.
Figure 2:
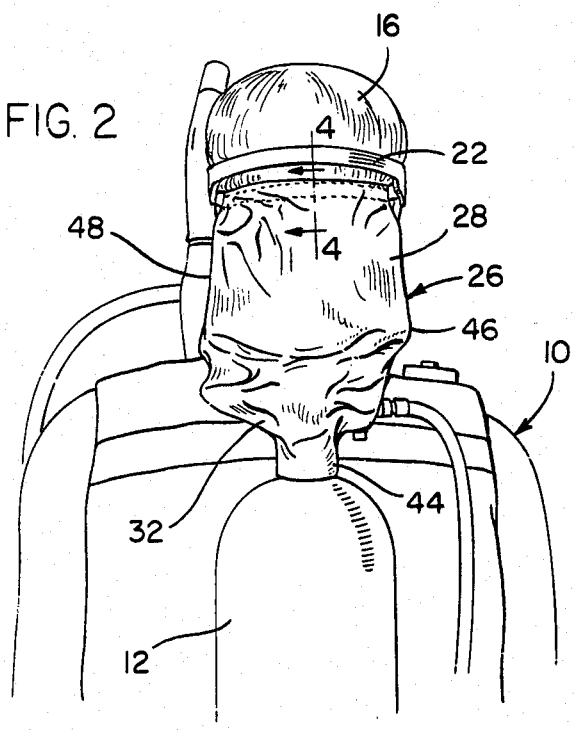
FIG. 2 is a rear elevational view of the assemblage illustrated in FIG. 2.

Referring now more specifically to FIGS. 1–4 of the drawings, the reference numeral 10 generally designates an underwater diver upon whose back a breathing air tank 12 is supported including an upper outlet equipped with a flow controlling valve 14. The diver's head 16 supports a diving mask 18 including a head encircling strap 20 whose rear or intermediate length portion includes upper and lower sections 22 and 24.

A first form of the kelp shield of the instant invention is referred to in general by the reference numeral 26 and incorporates an elongated flexible panel 28 having first and second ends 30 and 32.

The flexible panel may be conveniently constructed of nylon and the first end 30 defines a fold line 34 extending transversely thereof and on opposite sides of which the panel 28 has a pair of coacting thistle-type fastener strips 36 and 38 secured thereto. The panel 28 may be folded along the fold line 34 to fold the terminal end 40 of the panel 28 supporting the strip 36 back upon the adjacent portion of the panel 28 with the strips 36 and 38 removably engaged with each other to thus form a tubular hem 42, see FIG. 4.

The second or lower end 32 of the flexible panel 28 includes an integral transverse terminal end strap portion 44 which projects outward from the opposite longitudinal sides 46 and 48 of the flexible panel 28. The opposite ends of the strap portion 44 include a second pair of coacting thistle-type fastener strips 46 and 48, corresponding to the strips 36 and 38, secured to the opposite sides thereof. Accordingly, the opposite ends of the strap portion 44 may be overlap engaged with each other and removably secured together.

Figure 4:
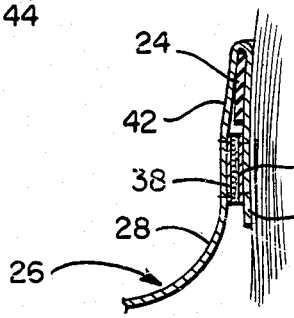
FIG. 4 is an enlarged vertical sectional view taken substantially upon the plane indicated by the section line 4—4 of FIG. 2.

In operation, the hem 42 is formed about the lower section 24 of the strap 20 in the manner illustrated in FIG. 4 whereby the first or upper end 30 of the flexible panel 28 is removably anchored to the strap 20. The flexible panel 28 extends downwardly and outwardly away from the lower section 24 and the strap portion 44 is encircled about the valve 14 and secured thereabout by overlapping engagement of the fastener strips 46 and 48 with each other.

In this manner, the flexible panel 28 forms a deflective shield between the back of the head 16 of the diver 10 and the upper portion of the air tank 12 to deflect kelp and to thereby prevent kelp from being entangled between the upper portion of the tank 12 and the back of the diver 10.

Figure 5:
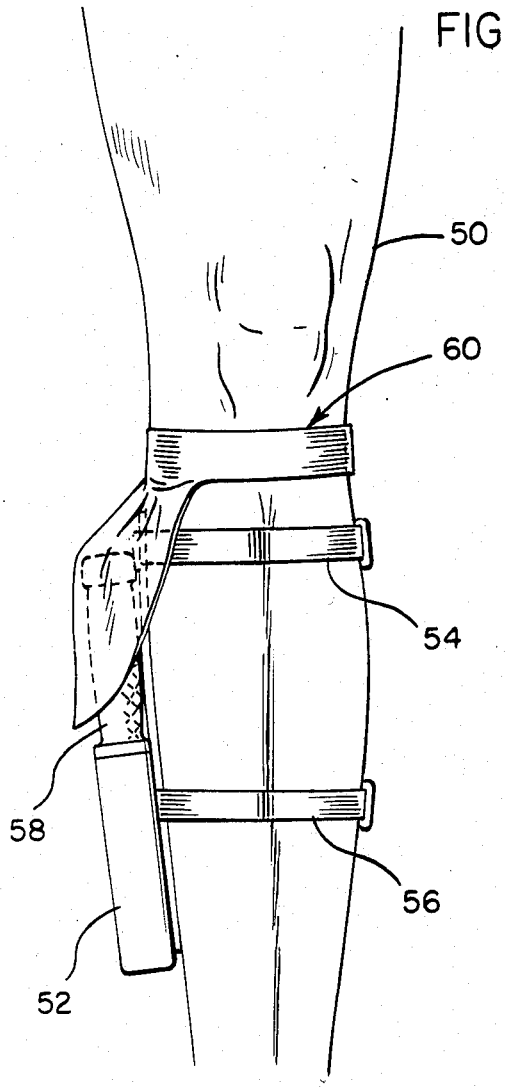
FIG. 5 is a front elevational view of the right leg of a diver illustrating the manner in which a second smaller form of the instant invention may be operatively associated with a leg worn knife sheath and attendant knife.
Figure 6:
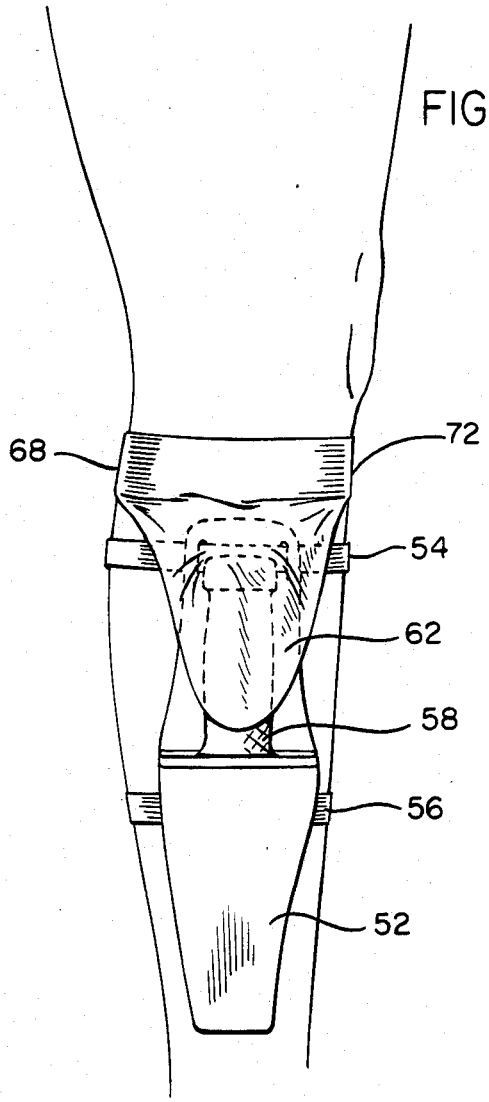
FIG. 6 is a side elevational view of the assemblage illustrated in FIG. 5 as seen from the left side thereof.
Figure 7:
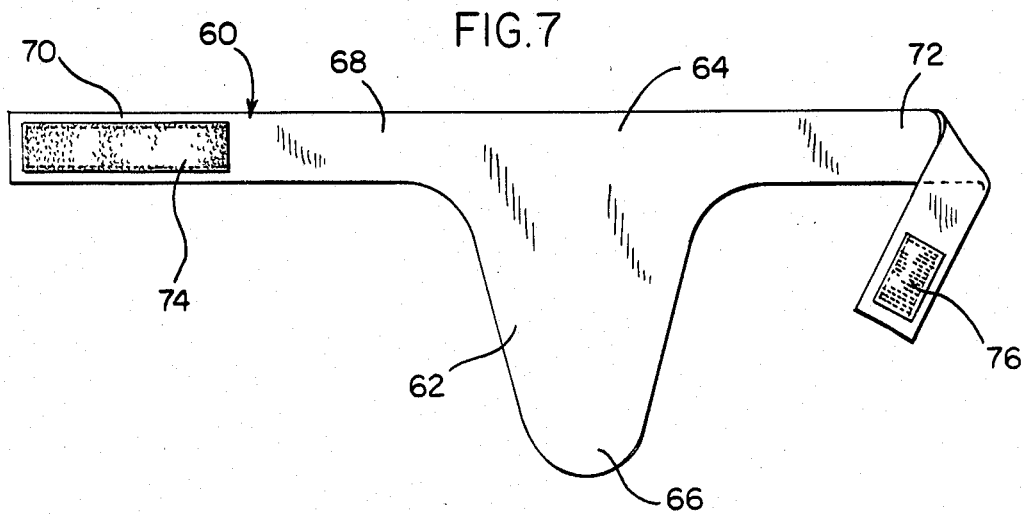
FIG. 7 is a plan view of the second form of the instant invention.

With attention now invited more specifically to FIGS. 5, 6 and 7 of the drawings, the numeral 50 designates the right leg of the diver. A knife sheath 52 is strapped to the calf portion of the leg 50 through the utilization of a pair of adjustable straps 54 and 56 and the handle 58 of a knife projects upwardly out of the sheath 52.

The second form of the instant invention is referred to in general by the reference numeral 60 and includes a flexible panel 62 having first and second upper and lower ends 64 and 66. The panel 62 is shorter than the panel 28 and the upper end 64 of the panel 62 includes an integral transverse strap portion 68 including opposite end portions 70 and 72 upon which a pair of coacting thistle-type fastener strips 74 and 76 are supported, the strips 74 and 76 being carried by opposite sides of the strap portion 68.

In operation, the opposite ends 70 and 72 of the strap portion 68 are passed about the upper calf portion of the leg 50 and disposed in overlapped engagement with each other and with the strips 74 and 76 releasably anchored to each other. The flexible panel 62 depends downwardly from the strap portion 68 and overlaps the handle 58 and the convex transverse curvature of the flexible panel 62 tends to maintain the lower end 66 of the panel portion 62 in position closely overlying the handle 58.

Of course, the kelp shield comprising the second form 60 deflects kelp away from the area of the upper end of the handle 58 and the opposing surfaces of the sheath 52 and leg 50. Therefore, kelp is prevented from being entangled inwardly of the handle 58.

It is pointed out that kelp can grow to extremely long lengths and that the entanglement of kelp with a diver's air tank or leg mounted knife and sheath can severely restrict subsequent movement of a diver through the water. This can be extremely dangerous in the event it becomes necessary for the diver to take defensive measures against dangerous marine life. Further, in the event of breathing apparatus failure or other reason to quickly surface, the entanglement of kelp with a diver's equipment can delay a diver from reaching the surface to a life threatening extent. Accordingly, the kelp shields 26 and 60 of the instant invention can, in some instances, save lives.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A kelp shield for preventing kelp from becoming entangled about a piece of diver's underwater equipment supported and projecting outward from a diver's first body portion above which a second body portion of the diver is disposed, said shield including a vertically elongated flexible panel having an upper end and a lower end, body portion encircling supportive strap means for securement about said second body portion, means securing said upper end to an intermediate portion of said strap means with said panel disposed generally normal to said intermediate portion, the lower end of said panel being adapted to lengthwise overlap at least a portion of said underwater equipment, said lower end of said flexible panel including transverse strap means supported therefrom, the last-mentioned strap means including opposite end portions from opposite sides of which coacting thistle-type fastener strips are supported, said strips being releasably engageable with last-mentioned strap means for securement about a valve body carried by the upper end of a tank by breathing air supported from said first body portion.

2. The shield of claim 1 wherein said strap means comprises a head strap of a diver's mask.

3. The shield of claim 1 wherein said piece of equipment comprises a tank of breathing air supported from the back of a diver and including an upstanding projecting valve body.

4. A kelp shield for preventing kelp from becoming entangled about a piece of diver's underwater equipment supported and projecting outward from a diver's first body portion above which a second body portion of the diver is disposed, said shield including a vertically elongated flexible panel having an upper end and a lower end, body portion encircling supportive strap means for securement about said second body portion, means securing said upper end to an intermediate portion of said strap means with said panel disposed generally normal to said intermediate portion, the lower end of said panel being adapted to lengthwise overlap at least a portion of said underwater equipment, said strap means comprising a head strap of a diver's mask, said upper end of said flexible pane including a transverse terminal end reversely folded back on and releasably secured to the adjacent portion of said panel to define a tubular hem, said head strap extending through said tubular hem.

* * * * *